US006341383B1

(12) United States Patent
Beltrani

(10) Patent No.: US 6,341,383 B1
(45) Date of Patent: Jan. 29, 2002

(54) ADJUSTABLE BACK STRAP FOR DIVING AND SWIMMING EQUIPMENT

(75) Inventor: Giovanni Battista Beltrani, Genoa (IT)

(73) Assignee: Technisub S.p.A., Genoa (IT)

( * ) Notice: Subject to any disclaimer, the term of this patent is extended or adjusted under 35 U.S.C. 154(b) by 577 days.

(21) Appl. No.: 08/804,466

(22) Filed: Feb. 21, 1997

(30) Foreign Application Priority Data

Feb. 23, 1996 (IT) ..... TO96A0117

(51) Int. Cl.[7] ..... A61F 9/02; A63B 31/11

(52) U.S. Cl. ..... 2/452; 441/64

(58) Field of Search ..... 2/426, 448, 449, 2/450, 451, 452, 338, 339, 300, 428, 430, 421, 427, 447, 311, 312, 321, 322, 301; 441/61, 62, 63, 64; 24/633, 614, 585, 615

(56) References Cited

U.S. PATENT DOCUMENTS

| | | | | |
|---|---|---|---|---|
| 2,705,802 A | * | 5/1955 | Tellier | |
| 2,799,020 A | * | 7/1957 | Currie | |
| 3,339,206 A | * | 9/1967 | Daley | |
| 3,940,815 A | * | 3/1976 | Hill | 441/64 |
| 4,527,292 A | * | 7/1985 | Kasama et al. | 2/426 X |
| 4,607,398 A | | 8/1986 | Faulconer | |
| 4,679,282 A | * | 7/1987 | Feng | 24/614 |
| 4,712,280 A | * | 12/1987 | Fildan | 24/633 X |
| 4,727,630 A | * | 3/1988 | Alan | 24/633 X |
| 4,779,291 A | * | 10/1988 | Russell | |
| 4,795,385 A | | 1/1989 | Matsuoka | |
| 5,033,171 A | * | 7/1991 | Kasai | 24/614 |
| 5,144,725 A | * | 9/1992 | Krauss | 24/633 X |
| 5,181,280 A | * | 1/1993 | Zachry | 2/452 |
| 5,259,798 A | * | 11/1993 | Runckel | 441/64 |
| 5,303,428 A | * | 4/1994 | Pernicka | 2/452 |
| 5,368,512 A | | 11/1994 | Brown | |
| 5,410,763 A | * | 5/1995 | Bolle | 2/452 X |
| 5,545,067 A | * | 8/1996 | Garofalo | 441/64 |
| 5,555,571 A | * | 9/1996 | McCaffrey | 2/452 X |
| 5,607,334 A | * | 3/1997 | Garofalo | 441/64 |
| 5,611,644 A | * | 3/1997 | Lutz | 24/585 X |
| 5,657,493 A | * | 8/1997 | Ferrero et al. | 2/452 X |

FOREIGN PATENT DOCUMENTS

| | | |
|---|---|---|
| EP | 0697179 | 2/1996 |
| EP | 0732259 | 9/1996 |
| WO | WO9000380 | 1/1990 |

* cited by examiner

*Primary Examiner*—Amy B. Vanatta
(74) *Attorney, Agent, or Firm*—Sughrue Mion, PLLC

(57) ABSTRACT

A back strap (1) for diving and swimming articles such as flippers (F), masks and goggles, is formed by two distinct and separate strap sections (1*a*, 1*b*) each of which is connected at one end (7) to a respective attachment member (3) having adjustment means (9) to vary the length of the strap (1). The two strap sections (1*a*, 1*b*) can be mutually connected and disconnected through a single buckle (2) having snap-fit lock and quick-release unlock performance.

13 Claims, 4 Drawing Sheets

F
P
S
R
B
M
3
4
5
6
7
8
9
10
1
1a
1b
2
11
12
13
14
17
20
21
22
24
25
28
29
30
48
51
IV

ADJUSTABLE BACK STRAP FOR DIVING AND SWIMMING EQUIPMENT

BACKGROUND OF THE INVENTION

The present invention is generally related to diving and swimming equipment or appliances, such as flippers, masks, goggles and the like having a seat adapted to be engaged by or onto a part of the user's body (foot-face).

More particularly, the invention is directed to a back strap for such diving equipment of the type including a substantially elastic band whose ends are connected to respective attachment members to be fastened to the equipment, at opposite sides of said seat, and at least one of which is provided with adjustment means to vary the length of the strap.

Straps of the above-referenced type are known, for instance, from Italian Utility Model n. 197.555 in the name of the same Applicant, and from U.S. Pat. No. 4,607,398. In both cases the attachment members of the strap, which are permanently fastened to the diving equipment structure, are provided with an adjustment device formed by a swinging latching lever which is normally kept, under the action of a spring, in engagement with latch teeth formed along the corresponding strap end, which is turned around a pin carried by the body of the attachment member.

According to this solution, adjusting the strap length is comfortable and easy but, particularly as far as flippers are concerned, fitting and removal maybe remarkably laborious and tiring. Namely, removal requires lengthening the strap at one or both ends and then disengagement thereof from the user's heel by sliding the strap beyond the foot.

In order to overcome this drawback, U.S. Pat. No. 4,795,385 provides that each attachment member has a buckle construction, with a stationary part permanently coupled with a respective side of the flipper and a movable part carrying the adjustment device, which can be connected to each other to perform quick opening and closing of the strap. This snap-fit system corresponds to that of a usual buckle employed for longtimes various applications, and release of which requires elastically pushing the two latch levers of the movable part towards each other, using at least two fingers of the user's hand, so as to perform disengagement thereof from the stationary part. Considering the encumbrance of the buckle as a whole, the size of the latching lever of each strap adjustment system is necessarily limited, whereby the length of the respective lever arm through which release of the strap can be operated is consequently limited. Accordingly, operation of the adjustment levers may be difficult and require a remarkable effort.

Even opening of the buckle, besides necessarily requiring a manual intervention, is uncomfortable and involves a certain effort, removing to the relatively advanced position of these buckles relative to the user's foot. This inconvenience is particularly critical in connection with unwearing flippers by a diver equipped with a full diving gear.

SUMMARY OF THE INVENTION

The object of the present invention is to overcome the above drawbacks, and namely to provide a back strap of the above-referenced type whose opening and quick closing are made more comfortable and convenient, with a minimum effort, and by means of a construction which does not negatively affect functionality of the adjustment means of the strap length.

A further object of the present invention is to provide a back strap of the above-referenced type whose buckle means for performing opening and closing thereof are constructively simple, functional and inexpensive.

Another object of the invention is to provide a back strap of the above-referenced type which, particularly as far as application to a flipper is concerned, does not necessarily require a manual intervention for opening thereof.

A further object of the invention is to provide a back strap of the above-referenced type which, can in the open position of the buckle means, remains permanently anchored to the diving equipment at both end thereof, thus preventing any risks of accidental loss.

These and further objects are achieved, according to the invention, by virtue of the fact that an adjustable back strap for diving and swimming equipment of the type set-forth at the beginning is primarily characterized in that it is formed by two distinct and separate strap sections, each of which is connected at one end to a respective attachment member, and that said buckle means are applied to the ends of said two strap sections opposite to the respective attachment members.

The buckle means may comprise in practice a single buckle having quick opening and closing performance, which is preferably arranged substantially in the central area of the strap. Accordingly the two strap sections have a symmetrical configuration; alternatively, asymmetrical arrangements may also be contemplated, locating the buckle in a lateral area of the strap.

According to a preferred embodiment of the invention, a relatively soft bearing element is associated to the buckle to lay against an adjacent part of the user's body.

Preferably the buckle comprises at least a female coupling member and a male coupling member permanently anchored to the one and, respectively, to the other strap section, these male and female coupling members being snap engageable with each other upon mutual engagement thereof along a first direction, and being disengageable from each other following application from outside of a thrust along a second direction perpendicular to the first direction.

To such effect, the buckle conveniently comprises a movable release member separated from said male and female coupling members and elastically displaceable from an inoperative position towards an operative position to release said male coupling member relative to said female coupling member along said second direction.

By virtue of the above features, the back strap according to the invention provides the following advantages:

- operation of the adjustment means to vary the strap length is extremely easy: in order to shorten the strap and increase the retaining force thereof, it is sufficient to pull the two tails thereof coming out from the attachment members incorporating the adjustment means; to lengthen the strap and thus decrease its retaining force, it is sufficient to operate the latch levers of the adjustment means which, due to a longer lever arm thereof, are particularly functional;
- opening of the strap is particularly comfortable, can be performed by a single finger of the user's hand and, due to the rear positioning of the buckle, the user does not have to elongate excessively his arm;
- particularly as far as application of the back strap to a flipper is concerned, opening thereof can be easily and conveniently carried out by the heel or the sole of the other foot, either standing on a boat or wharf, or staying in the water;
- wearing again the equipment is easy, without any need of modifying the adjustment of the strap length: in this case it is in fact sufficient to close again the buckle behind the corresponding part of the user's body.

The strap according to the invention is applicable in a particularly advantageous way to flippers, but can be equally usefully employed in the case of other diving and swimming equipment, such as masks and goggles.

The invention will now be disclosed in detail with reference to the accompanying drawings, related to application of the back strap to a flipper, wherein:

DETAILED DESCRIPTION OF THE INVENTION

Figures 1, 2:
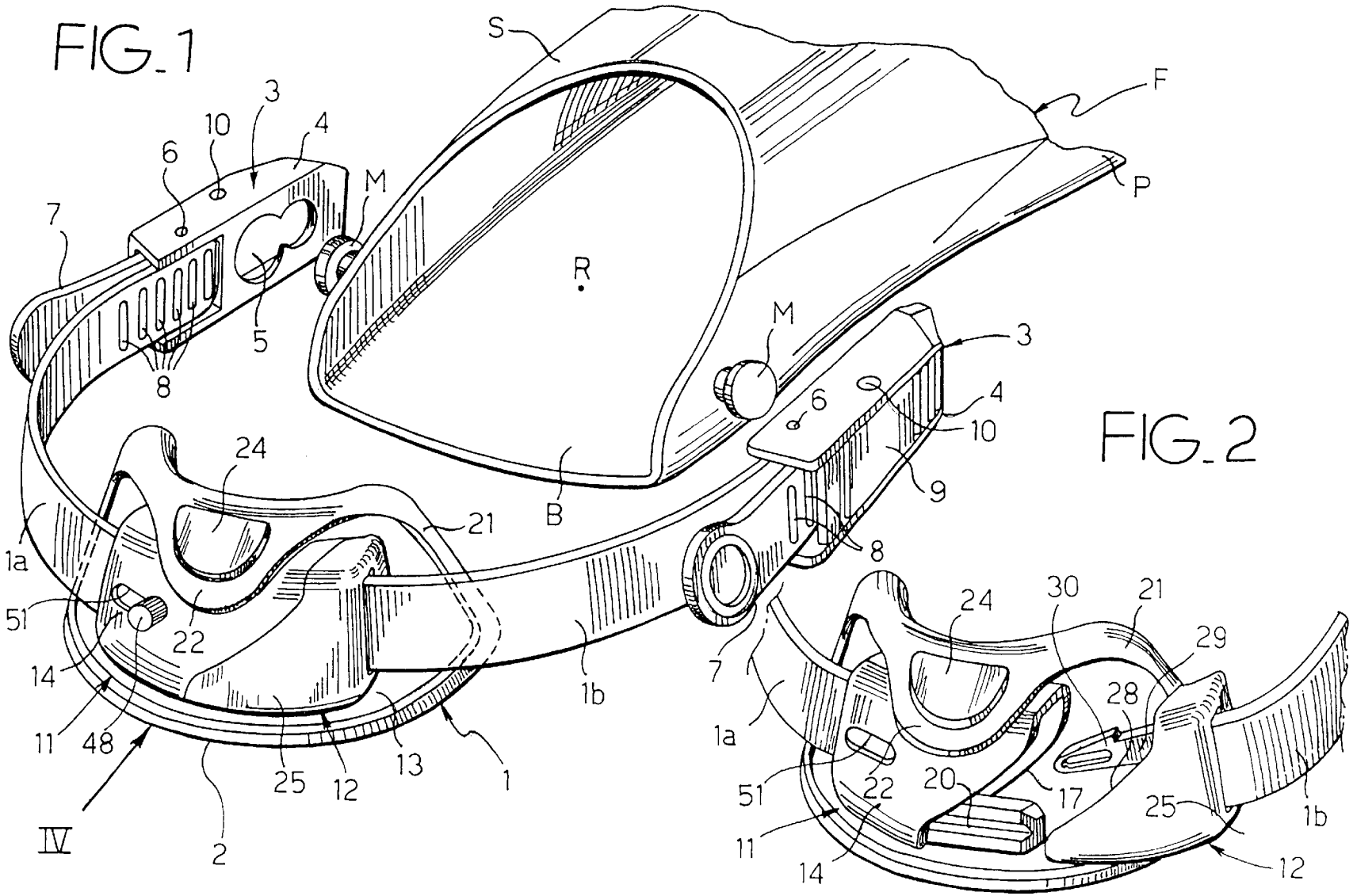
FIG. 1 is a perspective and partially exploded view showing a back strap according to a first embodiment of the invention applied to a swimming flipper and shown in the closed condition thereof.
FIG. 2 is a view similar to FIG. 1 showing part of the back strap in the opened condition.

Referring initially to FIGS. 1–9 of the drawings, reference F generally designates the rear portion of a swimming flipper, of a generally conventional type for instance disclosed and illustrated in U.S. Pat. Nos. 5,163,859; 5,435,764; 5,324,219 and 5,358,439 in the name of the same Applicant. Briefly, the flipper F comprises a relatively rigid blade P and a shoe S, made of a relatively soft material, permanently connected to the blade P by overmoulding and open at its end opposite to the blade P. The shoe S thus defines a receptacle R which is rearwardly open and lowerly delimited by a base or sole B of the same relatively rigid material forming the blade P. Two outer and oppositely extending head pins M are normally formed integrally with the blade P upon moulding of blade P are.

These pins M define anchoring elements for an adjustable back strap according to the invention, generally designated as 1.

According to a first aspect of the invention, the adjustable back strap 1 is formed by two strap sections 1*a*, 1*b*each having first and second ends, which are distinct and separate from each other and both normally made of elastomeric material. In accordance with a second aspect of the invention, the two strap sections 1*a*, 1*b* can be mutually connected and disconnected at the respective second ends by means of a quickly openable and closable buckle 2 which, in the case of the shown example, is located in correspondence of the central area of the strap 1, whereby the two sections 1*a*, 1*b* have same length. However different configurations may also be envisaged, in which the buckle 2 is for instance located laterally, whereby the strap sections 1*a*, 1*b* have a non-symmetrical design.

The first end of each strap section 1*a*, 1*b* is connected to a respective attachment member 3, of a generally conventional type incorporating an adjustment device provided to vary the operative length of each strap section 1*a*, 1*b*, i.e. the total useful length of the strap 1.

The attachment members 3 may be, for instance, of the type disclosed and illustrated in already mentioned Italian utility model No. 197.555 and in U.S. Pat. No. 4,607,398. Briefly, each attachment member 3 comprises a body 4 formed with a double aperture 5 for engagement and permanent anchoring thereof to a respective lateral head pin M of the flipper F, and also carrying a roller 6 around which the-outer end of the respective strap section 1*a*, 1*b* is wound. This outer end, whose tip tail is designated as 7, is formed with a number of transverse tooth projections 8 cooperating, in a known way, with a latching lever 9 which is swingable around a pin 10 and is normally kept, by the action of a spring member not illustrated, into engagement with the tooth projections 8. When the front area of the latch lever 9 is manually pushed, disengagement of the tooth projections 8 therefrom is performed, which consequently enables slipping the end of the corresponding strap section 1*a*, 1*b*, so as to allow lengthening of the member 3. While in the shown example both attachment members 3 are provided with a respective length adjustment device, it is to be pointed out that such a device could be applied only to one or to the other of the attachment members 3.

The buckle 2 is essentially formed by a female coupling member 11 and by a male coupling member 12 adapted to be snap connected to each other and quickly disconnected.

The female coupling member 11 comprises a base plate 13 defining a seat having an arcuate design, whose curvature corresponds to the average back curvature of a foot heel, and which is made of a relatively rigid material preferably consisting of a moulded thermoplastic material. The base plate 13 is rigid, for instance integrally formed by moulding, with a shell-like body 14 having, near to its outer side, a recess 15 (FIG. 8) housing therein an enlarged end head 16 of the strap section 1*a*. This strap section la is thus permanently anchored to the female coupling member 11, whose opposite side is open and has an oblique edge 17.

The upper part of the body 14 is formed with a window-like opening 18 (FIGS. 3 and 7) whose outer edge, i.e. the one facing towards the oblique edge 17, defines a hooking member 19, the function of which will be clarified here below.

The lower part of the body 14 is formed with a grooved guide appendage 20 which, owing to the oblique configuration of the edge 17, projects outwardly from the side opposite to the strap section 1*a*.

Preferably, but not necessarily, the face of the base plate 13 which is opposite to the body 14 is covered with a pad seat 21 made of a relatively soft and flexible material, for instance elastomeric material or thermoplastic rubber, which is secured to the female coupling member assembly 11 normally by overmoulding. As better depicted in FIGS. 8 and 9, the perimetral edges of the base plate 13 are incorporated within the pad element 21, i.e. are entirely covered thereby.

The pad element 21 is integrally formed with a bracket portion 22 projecting in a cantilever fashion above the window opening 18 of the body 14. This bracket part 22, which is thus springing relative to the body 14, centrally carries a push button 23 which is resiliently displaceable due to springing of the bracket part 22, such as explained herebelow, between an inoperative raised position and an operative lowered position in which it penetrates into the window opening 18. As it will also become apparent in the following, the push button 23 constitutes a movable release member, physically separated from the male and female coupling members 11, 12, by means of which opening of the buckle 2 is to be operated. The upper end of the push button 23, secured to the bracket part 22 through a restrainedjoint connection or any other equivalent system, may be conveniently covered by an enlarged anti-slip element 24 fixed onto the bracket part 22.

The male coupling member 12 comprises a body 25, also having a generally shell-like configuration and normally made of a moulded thermoplastic material, which is formed adjacent of its outer side with a recess 26 housing an enlarged end head 27 of the strap section 1*b*, which is thus permanently anchored to the male coupling member 12. The inner side of the body 25 is open and has an oblique edge 28 complementary to the oblique edge 17 of the body 14 of the female coupling member 11.

An upper springing arm 29 having a hooking tooth 30 complementary to the hooking seat 19, and a lower tubular guide element 31 complementary to the guide appendage 20 of the female coupling member 11, are integrally formed within the body 25.

Figure 13:
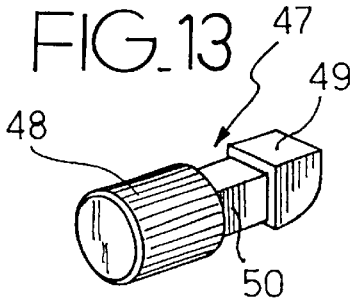
FIG. 13 is a perspective and enlarged view of a detail of the back strap shown in FIGS. 1 trough 9.
Figure 5:
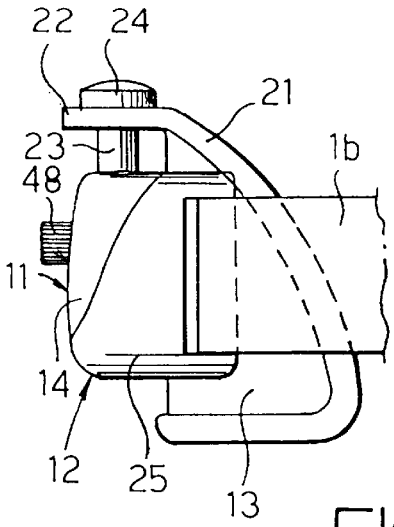
FIG. 5 is a lateral elevational view of FIG. 4.
Figure 4:
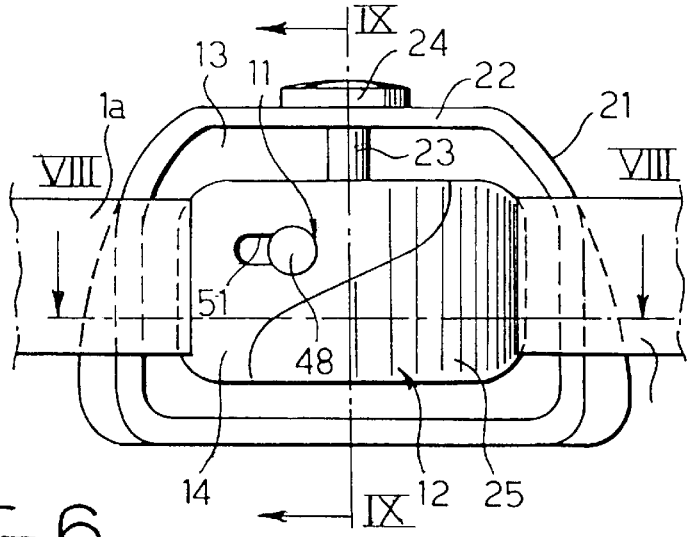
FIG. 4 is a front elevational view according to arrow IV of FIG. 1.
Figure 6:
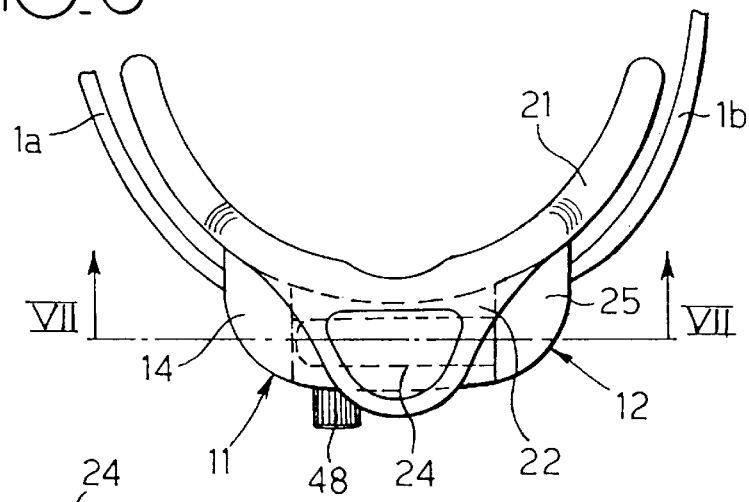
FIG. 6 is a top plan view of FIG. 4.
Figure 7:
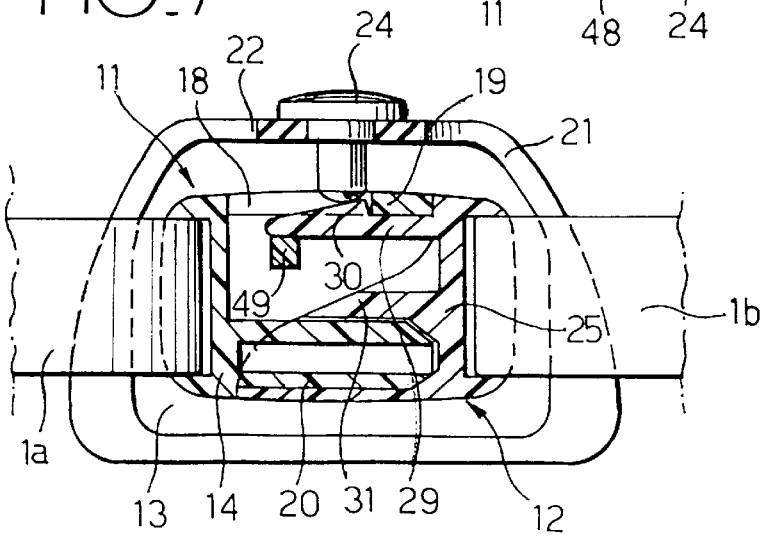
FIG. 7 is a vertically sectioned view along line VII—VII of FIG. 6.

Reference 47 designates a safety-catch member, preferably but not necessarily provided for preventing accidental opening of the buckle 2. As shown in better detail in FIG. 13, the safety catch member 47 comprises a slider having at one end a manually operable outer knurled knob 48 projecting rearwardly of the female coupling member 11, at the opposite end an inner stop head 49 placed beneath the arm 29, and an intermediate shank 50 (normally having a prismatic shape) slidably fitted under friction along a horizontal slot 51 of the female coupling member 11. Through the outer knurled knob 48, the safety catch 47 is displaceable along the slot 51 between a lock position (towards the right in the drawings) in which the stop head prevents downward displacement of the arm 29, even in case of pressure upon the push button 23, and an unlock position (towards the left in the drawings) in which elastic deformation of the arm 29 following operation of the push button 23 is instead enabled. Retaining formations of the safety catch 47 in either positions can also be provided.

From the above disclosure, it will be apparent that the buckle 2 of the strap 1 according to the invention has a general configuration conceptually similar to that of a buckle for motorvehicle safety belts, having a push button for quick release of a male hooking member relative to a female hooking member. The elastic member performing quick separation between the two male and female hooking members (which in the buckles for motorvehicle safety belts is constituted by a suitable inner spring) is, according to the invention, formed by the two strap sections 1*a*, 1*b* themselves which, in use with the buckle 2 in the closed condition, are kept under resilient traction.

More specifically, operation of the buckle 2 according to FIGS. 1–9 is as follows.

Figure 3:
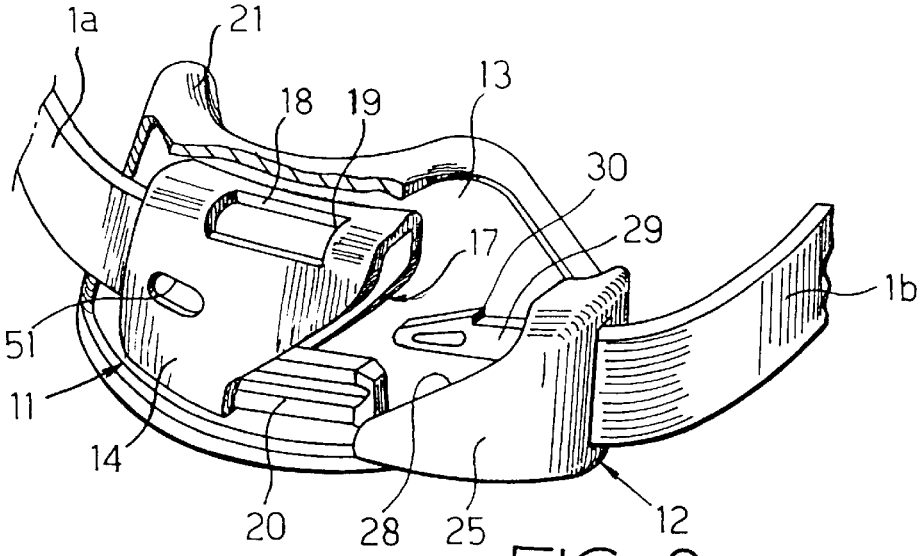
FIG. 3 is a view similar to FIG. 2 but partially broken.
Figure 8:
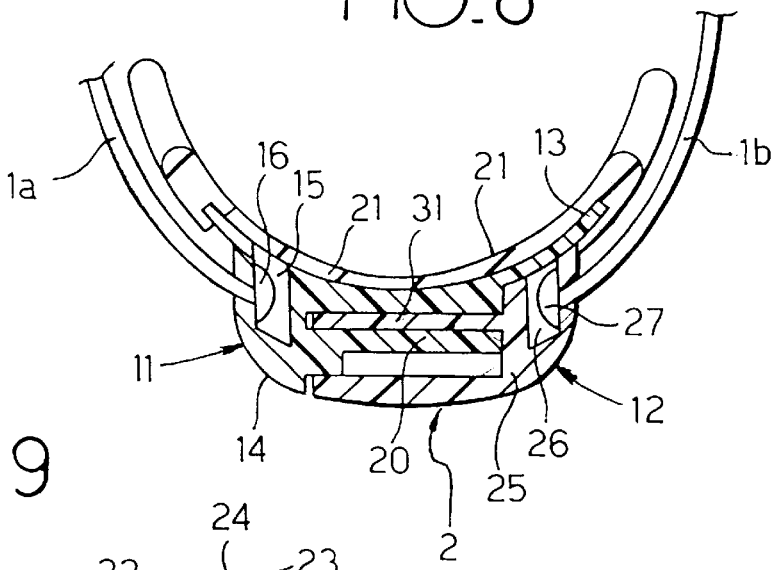
FIG. 8 is a horizontally sectioned view along line VIII—VIII of FIG. 4.
Figure 9:
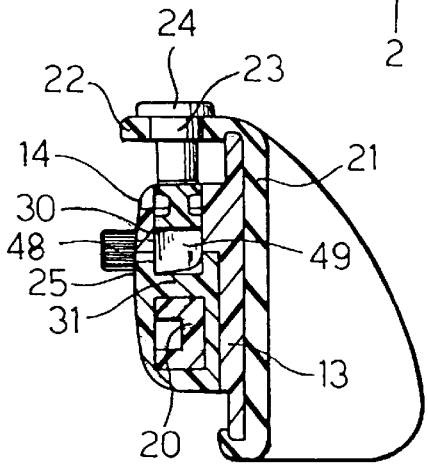
FIG. 9 is a vertically sectioned view along line IX—IX of FIG. 4.

In the open condition, depicted in FIGS. 2 and 3, the female coupling member 11 and the male coupling member 12 are separated form each other, with the respective strap sections 1*a*, 1*b* permanently anchored to the opposite sides of the receptacle R of the flipper F, due to engagement of the respective attachment members 3 onto the head pins M.

The user can easily fit his foot into the flipper receptacle R, and then restrain the heel relative thereto following closure of the buckle 2. To do so, it is sufficient to bring the female coupling member 11 and the male coupling member 12 together, introducing and sliding the guide appendage 20 of the former into the tubular guide element 31 of the latter, and then fitting the arm 29 of the latter into the body 14 of the former, after positioning the safety catch 47 in the unlock condition. Following this action, the hooking tooth 30 snap-fits within the window opening 18, thus engaging behind the hooking seat 19 so as to lock the male coupling member 12 relative to the female coupling member 11, such as shown in detail in FIGS. 7 and 8. In this position, the oblique edges 17 and 28 of the body 14 and of the body 25 of the two coupling members 11 and 12 meet as depicted in FIGS. 1 and 4 through 6, thus defining a single closed cover housing. The heel of the user's foot thus comfortable bears against the soft pad element 21, and the length of the strap 1 formed by the two sections 1*a*, 1*b* connected therebetween by the buckle 2 can be easily adjusted by means of the two adjustment devices 9. In this condition, as shown in better detail in FIGS. 7 and 9, the push button 23 is positioned immediately above the hooking tooth 30 engaged within the window opening 18, and is held in its raised inoperative position by the springing bracket part 22. Positioning of the safety catch 47 in the locking condition prevents accidental opening of the buckle 2 such as previously explained.

To operate opening of the buckle 2 it is sufficient, following manual displacement of the safety catch 47 to the unlock position, to apply a pressure from above downwardly onto the springing bracket part 22, acting on the anti-slip element 24, so as to urge the push button 23 towards the window opening 18. This operation can be carried out manually, with a single user's finger or—more comfortably—with the other user's foot. Lowering of the push button 23 causes elastic downward deformation of the springing arm 29 and, consequently, disengagement of the hooking tooth 30 relative to the hooking member 19. Since as explained in the worn condition of the flipper on the user's foot the two strap sections 1*a*, 1*b* are normally under tensile stress, resilient action thereof produces quick separation between the female coupling member 11 and the male coupling member 12, whereby the user's foot can be promptly withdrawn from the receptacle R of the flipper F without any hindrance.

In summary, opening of the buckle 2 according to the preferred embodiment of FIGS. 1–9 is in practice carried out following a thrust applied from outside along second direction which is at a right angle relative to the coupling/uncoupling direction of the female and male coupling members 11, 12. This direction might however also be oblique or parallel with respect to the coupling/uncoupling direction between the female and male coupling members 11, 12, as in the case of the alternative embodiment which will be further disclosed with reference to FIG. 10.

As previously clarified, the strap 1 according to the invention can be applied not only to flippers, but also to any other diving or swimming equipment having a seat adapted to be engaged by a part of the user's body and to be closed thereagainst. Examples of such equipment include diving masks, swimming goggles and the like. In these cases, the two strap sections 1*a*, 1*b* will be permanently anchored at the opposite sides of the equipment body (the frame carrying the transparent visor of a diving mask, the frames carrying respective transparent lenses of the goggles), and the arrangement of the buckle 2 will be substantially identical to that previously disclosed. The only remarkable difference may consists of a different and lower curvature of the base plate 13 and related soft pad element 21 of the female coupling member 11. Moreover, the release push button 23 could in these cases be arranged below instead of above the buckle 2. This arrangement can evidently be obtained simply turning the buckle 2 upside down, and accordingly the thrust onto the release push button 23 to operate opening of the buckle 2 will be directed from below upwardly. This arrangement may also be employed when the buckle 2 is applied to a flipper: in this case, opening could be operated by the same user's foot wearing the flipper, abutting the push button 23 against any available reaction surface.

As also previously pointed out, the buckle 2 may be positioned, instead of in correspondence of the central area of the strap 1, in a lateral area thereof: accordingly the two strap sections 1*a*, 1*b* shall evidently have an uneven length.

Figure 10:
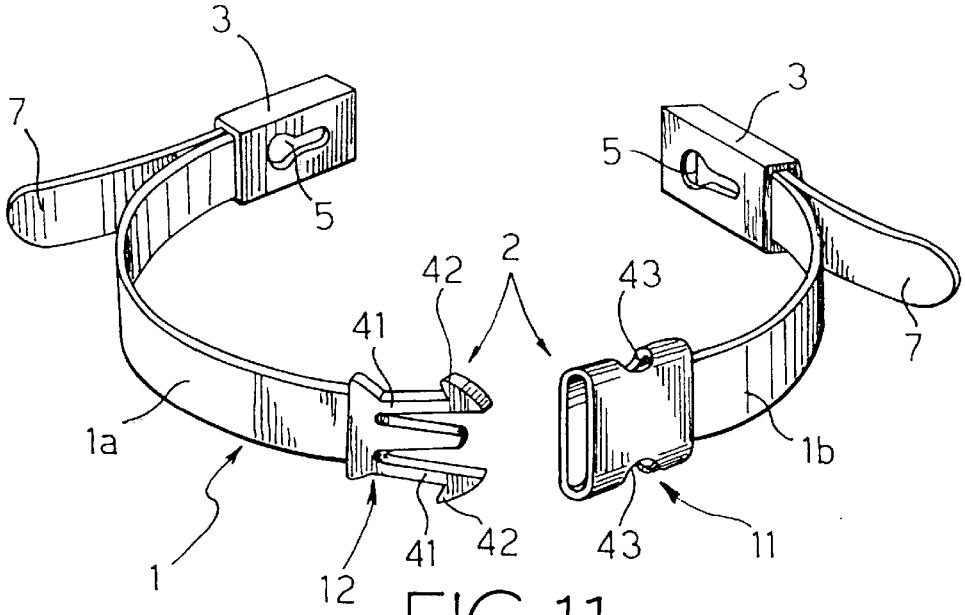
FIG. 10 is a diagrammatic perspective view showing a first variant of the back strap according to the invention depicted in the open condition.

Naturally the details of construction and the embodiments may be widely varied with respect to what has been disclosed and illustrated, without thereby departing from the scope of the present invention, such as defined in the appended claims. Thus, for instance, the locking and unlocking system between the two elements constituting the buckle 2 may be different from that disclosed and illustrated in the example of FIGS. 1–9, and for instance be provided, as shown in FIG. 10, with a conventional construction wherein the male coupling member 12 has a pair of juxtaposed springing arms 41 with respective hooking teeth 42 adapted to snap-fit engage corresponding recesses 43 of the female coupling member 11. This solution, while ensuring easy and convenient locking and unlocking performances, is however less comfortable for the user, since unlocking thereof requires application of two opposite thrust forces upon said springing arms, and thus operation of at least two fingers of the user's hand. Moreover, in the case of application of the strap according to the invention to a flipper, such a construction is less advantageous than the one disclosed with reference to the embodiment shown in the drawings, since opening of the buckle 1 could not be operated by the user's foot.

Figure 11:
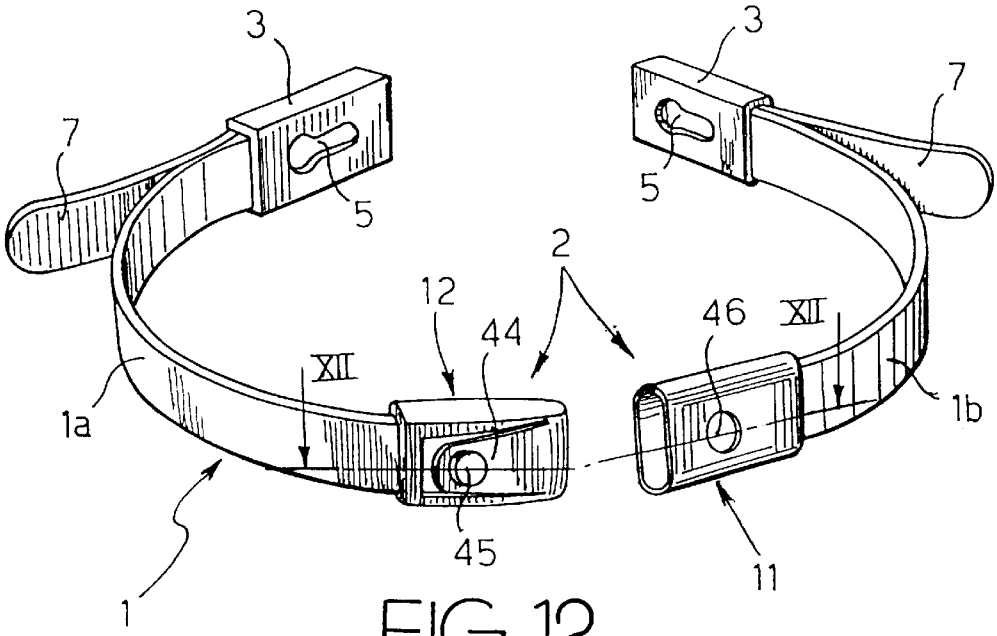
FIG. 11 is a view similar to FIG. 10 of a second variant of the invention.
Figure 12:
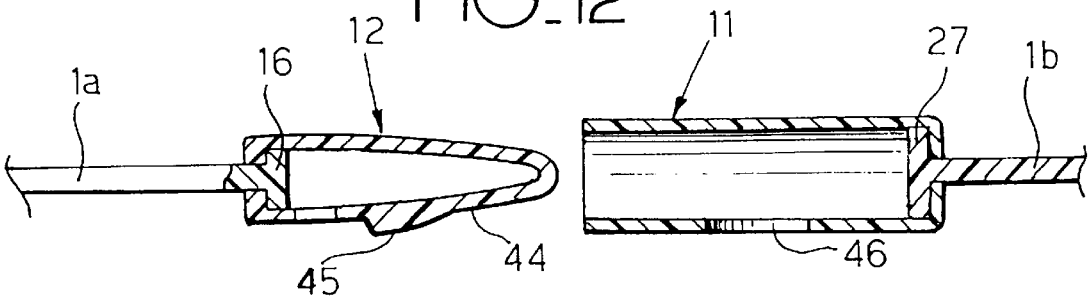
FIG. 12 is a sectioned view along line XII—XII of FIG. 11.

According to a further alternative embodiment, shown in FIGS. 11 and 12, the male coupling member 12 has a springing wing 44 adapted to be fitted into the female coupling member 11 and formed with a button 45 snap-fit engageable into a back hole 46 of this female coupling member 11. This solution, also constructively simple, provides with respect to the embodiment of FIG. 10 the advantage of being operable, so as to open the buckle 2, by pressing the button 45 with a single user's finger or even with his foot.

Also the construction and arrangement of the push button 23 previously disclosed with reference to the preferred embodiment of FIGS. 1–9 may be different: in particular, the elastic member keeping this push button 23 in its inoperative position could be constituted, instead of the springing bracket part 22 integrated with the pad element 21, by a suitable return spring. Additionally the anti-slip element 24 may have a concave shape so as to allow convenient operation thereof by means of an auxiliary tool, for instance constituted by a simple rod carried by or anyhow available to the user. Lastly, the push button 23 may be integrated with a projecting lever or arm, for instance upwardly inclined, for a more convenient actuation thereof.

What is claimed is:

1. An adjustable back strap for diving and swimming equipment having a seat to be engaged by a part of the user's body, said back strap having opposite ends, a pair of attachment members connected to said ends of said strap for securement to said equipment at opposite sides of said seat thereof, at least one of said attachment members being provided with adjustment means to vary the length of the strap, and buckle means provided on said strap to perform quick opening and closing of said strap, wherein said strap is formed by two distinct and separate strap sections each having respective first and second ends, the first end of each section being connected to a respective one of said attachment members and said buckle means being connected to said second ends of said strap sections for connecting and separating said strap sections relative to each other.

2. Strap according to claim 1, wherein said buckle means comprise a single buckle.

3. Strap according to claim 2, wherein said single buckle is arranged substantially in a central area of said strap, whereby said two strap sections have substantially even length.

4. Strap according to claim 2, wherein a relatively soft pad is connected to said buckle to lay against said part of the user's body.

5. Strap according to claim 2, wherein said buckle comprises a female coupling member and a male coupling member permanently anchored to said second ends of said strap sections, said female and male coupling members being snap engageable with each other upon mutual connection thereof along a first direction, and being disengageable from each other following application from outside of a thrust along a second direction substantially perpendicular to said first direction.

6. Strap according to claim 5, wherein said buckle comprises a movable release member carried by said female coupling member and elastically displaceable from an inoperative position towards an operative position to disengage said male and female coupling members relative to each other.

7. Strap according to claim 6, further comprising safety catch means mounted on said buckle and manually operable between a rest position and a work position to prevent accidental displacement of said movable release member from said inoperative to said operative position.

8. Strap according to claim 6, wherein said release member is a springing push button.

9. Strap according to claim 8, wherein:

said female coupling member comprises a substantially rigid hollow body having a hooking seat, and a springing bracket element permanently and externally connected to said hollow body, said springing push button is carried by said springing bracket element above said hooking seat of said hollow body of the female coupling member, said male coupling member comprises a substantially rigid hollow body provided with a springing-arm having a hooking tooth complementary to said hooking seat of said body of the female coupling member and snap-engageable therewith beneath said push button.

10. Strap according to claim 9, wherein said bodies of said female and male coupling members are further provided with respective slidably-cooperating inner guide means.

11. Strap according to claim 9, wherein said bodies of said female and male coupling members define, in their mutually engaged condition, a closed cover housing.

12. Strap according to claim 9, wherein a relatively soft pad member adapted to lay against said part of the user's body is connected to said body of said female coupling member, said pad member being formed integrally with said springing bracket element carrying said springing push button.

13. A swimming flipper having an adjustable back strap, said swimming flipper being comprised of a blade, a shoe fixed to the blade, and having a receptacle for introduction of a user's foot and said adjustable back strap having opposite ends, a pair of attachment members connected to said ends of said strap for securement to said flipper at opposite sides of said receptacle, at least one of said attachment members being provided with adjustment means to vary the length of the strap and buckle means provided on said strap to perform quick opening and closing of said strap, wherein said strap is formed by two distinct and separate strap sections each having respective first and second ends, the first end of each section being connected to a respective one of said attachment members and said buckle means being connected to said second ends of said strap sections for connecting and separating said strap sections relative to each other.

* * * * *